US010606216B2

(12) United States Patent
Dubois et al.

(10) Patent No.: US 10,606,216 B2
(45) Date of Patent: Mar. 31, 2020

(54) WATCH CASE COMPRISING REMOVABLE HORNS

(71) Applicant: LVMH Swiss Manufactures SA, La Chaux-de-Fonds (CH)

(72) Inventors: Antoine Dubois, Villers-le-Lac (FR); Laurent Raille, Maiche (FR)

(73) Assignee: LVMH SWISS MANUFACTURES SA, La Chaux-de-Fonds (CH)

( * ) Notice: Subject to any disclaimer, the term of this patent is extended or adjusted under 35 U.S.C. 154(b) by 0 days.

(21) Appl. No.: 15/766,452

(22) PCT Filed: Oct. 6, 2016

(86) PCT No.: PCT/IB2016/055981

§ 371 (c)(1),
(2) Date: Apr. 6, 2018

(87) PCT Pub. No.: WO2017/060842

PCT Pub. Date: Apr. 13, 2017

(65) Prior Publication Data

US 2018/0299832 A1 Oct. 18, 2018

(30) Foreign Application Priority Data

Oct. 6, 2015 (CH) ..... 1444/15

(51) Int. Cl.
*G04B 37/14* (2006.01)
*G04B 37/22* (2006.01)

(52) U.S. Cl.
CPC ..... *G04B 37/1486* (2013.01); *G04B 37/14* (2013.01); *G04B 37/22* (2013.01)

(58) Field of Classification Search
CPC .... G04B 37/1486; G04B 37/14; G04B 37/22; A44C 5/14
See application file for complete search history.

(56) References Cited

U.S. PATENT DOCUMENTS 4,493,561 A * 1/1985 Bouchet ..... G04B 37/0472 368/223
5,732,048 A 3/1998 Klingenberg
(Continued)

FOREIGN PATENT DOCUMENTS

CH 321188 A 4/1957
CH 355094 A 6/1961
(Continued)

OTHER PUBLICATIONS

International Search Report for PCT/IB2016/055981 dated Feb. 1, 2017.

*Primary Examiner* — Edwin A. Leon
*Assistant Examiner* — Jason M Collins
(74) *Attorney, Agent, or Firm* — Pearne & Gordon LLP

(57) ABSTRACT

Watch case including: a case middle; removable horns; and at least one nut. The nut is inserted in a housing formed in the thickness of the case middle. A nut portion protrudes to the outside of the case middle. A removable horn-retaining screw is engaged in each nut. The thickness required to accommodate the screw is not supported by the case middle, but by the projecting nut portion. It is thus possible to make case middles that are very thin, and therefore light-weight, while at the same time ensuring attachment of the horns to the case middle.

15 Claims, 2 Drawing Sheets

(56) References Cited

U.S. PATENT DOCUMENTS

| | | | | |
|---|---|---|---|---|
| 9,004,329 | B2 * | 4/2015 | Hsieh | G04G 17/08 224/169 |
| 9,961,970 | B2 * | 5/2018 | Boutherin | A44C 5/145 |
| 2006/0280393 | A1 * | 12/2006 | Ebi | F16C 19/163 384/523 |
| 2013/0286796 | A1 * | 10/2013 | Chatelain | G04B 37/0008 368/282 |

FOREIGN PATENT DOCUMENTS

| | | | |
|---|---|---|---|
| CH | 685035G | A3 | 3/1995 |
| CH | 701221 | A1 | 12/2010 |
| CH | 705240 | A2 | 1/2013 |
| CH | 706260 | A2 | 9/2013 |
| EP | 0400206 | A1 | 12/1990 |
| EP | 0471834 | A1 | 2/1992 |
| EP | 1902641 | A1 | 3/2008 |
| EP | 2188676 | A1 | 5/2010 |
| EP | 2431825 | A1 | 3/2012 |
| EP | 2672337 | A1 | 12/2013 |
| WO | 2005029204 | A1 | 3/2005 |
| WO | 2009030984 | A1 | 3/2009 |

* cited by examiner

WATCH CASE COMPRISING REMOVABLE HORNS

TECHNICAL FIELD

The present invention relates to a watch case comprising removable horns, in particular for a wristwatch. The present invention also relates to a method of attaching horns to the case middle of a watch.

STATE OF THE ART

Known wristwatch case middles generally consist of a single piece made by stamping while integrating the horns, i.e. to say portions of the middle that serve to attach the bracelet by enclosing it from both sides. In the case of horns having complex shapes, the manufacture of this part is difficult and not suitable for mass production.

There are also parts of watch cases in which the case middle and the horns are manufactured separately and assembled to each other afterwards. These cases are easier to manufacture. Furthermore, the outer faces can be finished by turning, so more neatly and more quickly than those of a case middle made directly with the horns.

Document CH706260, filed by the applicant, describes a watch case part comprising a middle and removable horns connected to one another by a connecting part. The case middle comprises a recessed location for each horn and a recessed location for each connecting part. The depth of these locations makes it possible to position the base of the horns while masking the connecting part. The fastening of the connecting part to the case middle is provided by two perpendicular screws going through each horn and engaged in tapped holes in the thickness of the middle. This solution therefore requires a sufficiently thick case middle to make the locations mentioned for the base of the horns and the tapped holes for the horn holding screws. Such a middle is therefore heavy. Furthermore, a thick case middle is well suited for sports watches or for men's watches; however, it does not meet the aesthetic criteria of some elegant watches, especially ladies' watches.

Document EP2431825 discloses removable horns, with each horn comprising two protruding elements which can be inserted into corresponding recesses. The connection between the horn and the case middle is effected by making use of the deformation of the projecting elements when they are inserted into the recesses. This solution requires a thick middle to achieve the locations able to cooperate with the projecting elements. Furthermore, there is a risk of breaking the horns if the force exerted to deform the projecting elements in order to achieve the connection with the case middle is too great.

Document CH701221 describes a middle whose outer lateral surface comprises a mortise. The end of a horn includes a stud of the same squaring as the mortise. The stud is arranged to be inserted into the mortise, the two parts being then connected by a pin in a housing formed by holes in the middle and in the stud. In this solution, the thickness and the height of the case middle are important, in order to make the mortise.

Document EP2188676 discloses a watch case with a middle and two pairs of horns. The two horns of each pair are connected by a connecting part having a side held against the middle by means of an elastic member inside the case middle. This elastic member is connected to the connecting part through an opening located on the outline of the case middle. This solution therefore requires an elastic member inside the case middle, whose assembly is complicated.

EP1902641 describes a watch case without horns, but which allows a bracelet to be fastened rotatably by means of a trunnion connected to the case middle and an insert connected to the bracelet. The trunnion has a threaded rod which engages in an insert of the bracelet. It is therefore necessary to screw the trunnion from the inside of the case middle, which makes assembly and especially disassembly very difficult.

The documents CH355094 and CH321188 require a thick middle to be able to make the housing designed to receive a connecting part of the horns.

Document EP0400206 describes a case middle of a wristwatch whose bracelet is held to the case middle by means of a locking element that can be positioned in a cavity of a part external to the case middle and connected to its external surface. This part cooperates with rods allowing the attachment of the bracelet.

Document EP0471834 discloses a rectangular case middle of a wristwatch comprising a bore in one side of the case middle and whose wall is traversed by an axial slot of a width greater than the thickness of the bracelet. An elastic tubular blade and a sleeve with one end closed are inserted into this slot. The tubular blade comprises a toothed axial slot in which the free end of a flexible bracelet is inserted. The axial insertion of the tubular blade into the sleeve requires an elastic deformation of the blade causing a locking of the free end of the bracelet by pinching the toothed slot. This solution requires a case middle having a large thickness to achieve the axial slot receiving the sleeve and the elastic tubular blade. Furthermore, this solution is only suitable for flexible bracelets.

Document U.S. Pat. No. 5,732,048 describes a watch middle comprising a first hole extending in a first direction (perpendicular to the plane of the movement), arranged to receive a cylinder, and a second hole extending in a second direction perpendicular to the first (and thus in the plane of the movement), and arranged to receive a screw connected to a connecting part of a bracelet. The cylinder comprises two openings, the first of which is arranged for receiving this screw, and the second for receiving another screw for fastening the case middle at the bottom of the watch case. The middle requires a large thickness to accommodate the holes receiving the connection screw to the bracelet as well as the cylinder.

Document CH705240 describes a watch case comprising a case middle and removable horns attached to the case middle by means of a fastening plate inserted against a flat part of the case middle. Screws for holding the horns pass through this plate and retain it through tapped holes in the middle of the case. The middle requires a large thickness to accommodate the threaded holes receiving these screws, as well as to provide a flat part.

Document CH685035 relates to another watch case without horns. The bracelet is fastened by means of pins held by means of screws vertically engaged from the bottom of the watch case. This solution also requires a very large thickness of the case middle.

BRIEF SUMMARY OF THE INVENTION

One aim of the present invention is to provide a watch case with a horn attachment system to the case middle that is free of the limitations of known systems.

Another aim of the invention is to provide a watch case for attaching removable horns and provided with a middle section that is thinner than the known cases.

Another aim of the invention is to provide system for attaching horns to a case middle suitable for elegant watches or ladies' watches.

Another aim of the invention is to provide a watch case with a removable horn fastening system that is simpler than the known solutions.

According to the invention, these objects are achieved in particular by means of a watch case comprising:

a case middle;

removable horns;

at least one nut removably inserted in a housing provided in the thickness of the case middle, so that a nut portion projects protruding outwardly of the case middle;

a removable horn-holding screw engaged radially in each said nut.

This solution has the advantage of holding the removable horns by means of removable nuts protruding radially towards the outside of the case middle. Therefore, it is not necessary to provide a very thick middle for tapping a hole for the holding screws. A sufficient number of thread pitches can be provided in the projecting portion of the nut.

The nut is removable and concealed in the housing of the case middle and by the horns. It is thus possible to make the nut in a material different from that used for the case middle. For example, and without limitations, it is advantageous to make the nut in a particularly resistant material, for example steel, stainless steel, titanium, etc., and to use a more decorative or less allergenic material for the case middle, for example a less hard metal, a precious metal, a ceramic, etc.

The nut can be a blind nut.

In a variant, the nut is made of the same material as the case middle.

Each nut may include a plate to retain it in its housing in the case middle, as well as a threaded nut portion and mounted on the plate. The threaded nut portion is prominent on the outer lateral face of the case middle and allows the horns to be screwed. The plate allows the nut to be held in the case middle.

In the context of the present invention, the word "plate" designates a flattened and thin part. In the context of the present invention, a plate is considered thin if its thickness is less than 1 mm, for example less than 0.8 mm, preferably equal to 0.5 mm.

In a preferred embodiment, the plate and the threaded nut portion form a single piece (the nut), for example a metal part.

In one embodiment, the plate and the nut portion can be made of two different materials: for example, the plate can be made of hard plastic and the threaded element of metal, or the plate can be made of a metal different from that of the threaded element.

Advantageously, the plate is slipped into a slot of the case middle.

The edge of the slot, on the edge of the case middle, can be concealed by a bezel of the watch case.

The thickness of the plate is advantageously less than that of the walls of the case middle.

In a preferred embodiment, the thickness of the plate is less than that of the threaded nut portion. In a preferred embodiment, the thickness of the threaded nut portion is equal to or greater than 1 mm, preferably equal to 1.2 mm or more.

The fastening system according to the invention therefore has the advantage of being able to achieve a thinner case middle than the case middle of known fastening systems.

In one embodiment, the horns are connected two by two by a connecting element. At least one said holding screw passes through each connecting part to hold it against the case middle.

In a preferred embodiment, the watch case comprises two screws which pass through the connecting part, and four nuts, with each nut being housed in a corresponding housing of the case middle. Each pair of horns is then held by two screws passing through the connecting part between the two horns and engaged in two corresponding nuts.

It is also possible that the horns are not connected by a connecting part, or that the connecting part does not include any through hole. In this case, each holding screw passes through each horn and is received by a corresponding nut. In this case, the length of the screws is greater because they must pass through the horns, which normally have a thickness greater than that of the connecting part.

In a variant, the watch case includes a cover, arranged to cover the connecting part of the horns and to be attached to the horns.

The length of the cover can correspond substantially to that of the connecting part. In one embodiment, it may comprise lateral fins which are arranged to slide during assembly in guides provided for this purpose in the horns.

In a variant, the connecting part comprises a protruding tab, cooperating with a notch in the case middle, so as to ensure vertical positioning of the connecting part, thanks to a stop.

In a preferred embodiment, this notch is placed between two housings of the fastening system according to the invention.

The present invention also relates to a watch, in particular a wristwatch, comprising the watch case part described here above.

The present invention also relates to a method for attaching removable horns to a case middle of a watch, comprising the following steps:

sliding at least one nut into a housing of the case middle, so that a nut portion projects protruding outwardly of the case middle;

screwing a screw into said nut so as to fasten a removable horn to the case middle.

BRIEF DESCRIPTION OF THE FIGURES

Examples of implementation of the invention are indicated in the description illustrated by the appended figures in which.

EXAMPLE(S) OF EMBODIMENT(S) OF THE INVENTION

Figure 1:
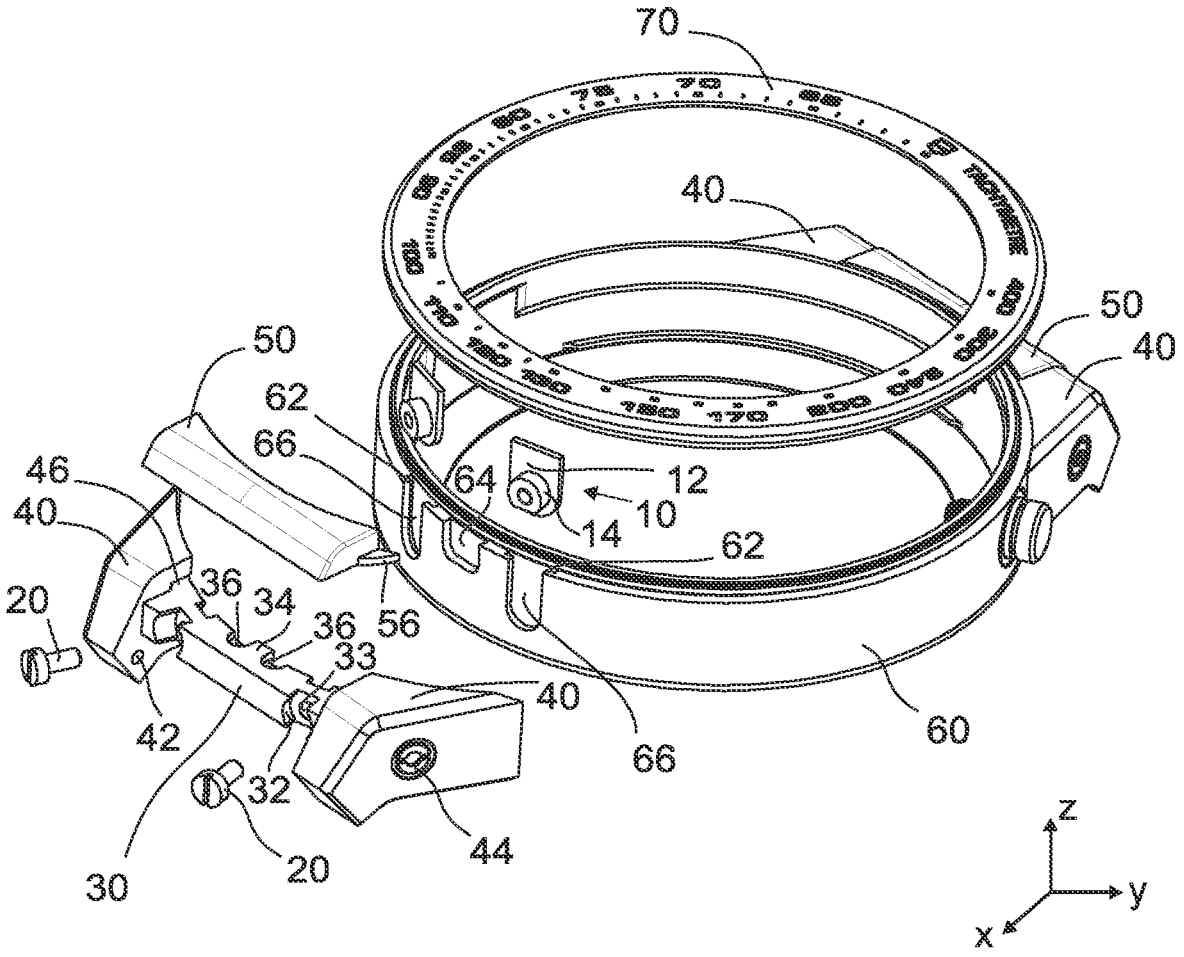
FIG. 1 illustrates a perspective and exploded view of the fastening system according to one embodiment of the invention, cooperating with a case middle and a bezel of a wristwatch.

FIG. 1 illustrates a perspective and exploded view of a watch case according to one embodiment of the invention.

The watch case includes notably a case middle 60 and a bezel 70. The case middle can be cylindrical and advantageously made by turning.

Removable horns 40 make it possible to connect the case middle to a bracelet, not shown. In this embodiment, the case middle comprises two pairs of horns 40. The two horns of each pair are connected to one another by a connecting part 30 on each side of the case middle.

The system for fastening the horns 40 against the outer lateral face of the case middle 60 comprises:

- two blind nuts 10; each blind nut 10 comprises a nut portion 14 and a plate 12 for inserting the nut 10 and for holding it in a housing, here a slot 62 formed in the thickness of the case middle 60;
- two screws 20 passing through each connecting part 30; each screw 20 is engaged in a nut 10.

The nuts 10 are thus removably mounted in housings in the thickness of the case middle.

A bracelet (not shown) may be attached to the horns 40 for example by means of a bar inserted into the holes 42 in the horns 40 (FIG. 1).

The two horns 40 and the connecting part 30 may form a single piece, or else three different parts, interconnected by connection means 44, for example screws as illustrated in FIG. 1.

Although in the example shown two screws 20 and two nuts 10 are used on each side of the watch case, the invention is not limited to such a configuration, and can be implemented with a single screw 20 going through the fastening element 30 and a single tapped plate 10. A higher number of screws 20 and tapped plates 10 ensures better attachment of the horns 40 to the case middle 60, but makes assembly longer.

In the example shown, the screws 20 pass through a connecting part 30 connecting two horns 40. However, the invention is not limited to this embodiment: indeed, it is also possible that the horns 40 are not connected by a connecting part 30, or that the connecting part 30 does not include any through hole 33. In one embodiment, not illustrated, each horn is individually fastened by at least one holding screw which passes through it and is engaged in a nut 10 removably mounted in the case middle. In this case, the length of the screws 20 is greater, because they must pass through the horns 40, which here have a greater thickness than that of the connecting part 30.

The plate 12 is a flat or curved part, of small thickness, for example less than 1 mm, for example equal to 0.5 mm.

In the example illustrated, the nut portion 14 is a cylinder provided with a blind hole inside which a screw thread is threaded. Of course, the invention is not limited to such a shape, and other shapes may be devised, for example and in a non limiting manner a cube provided with a tapped hole.

Figure 2:
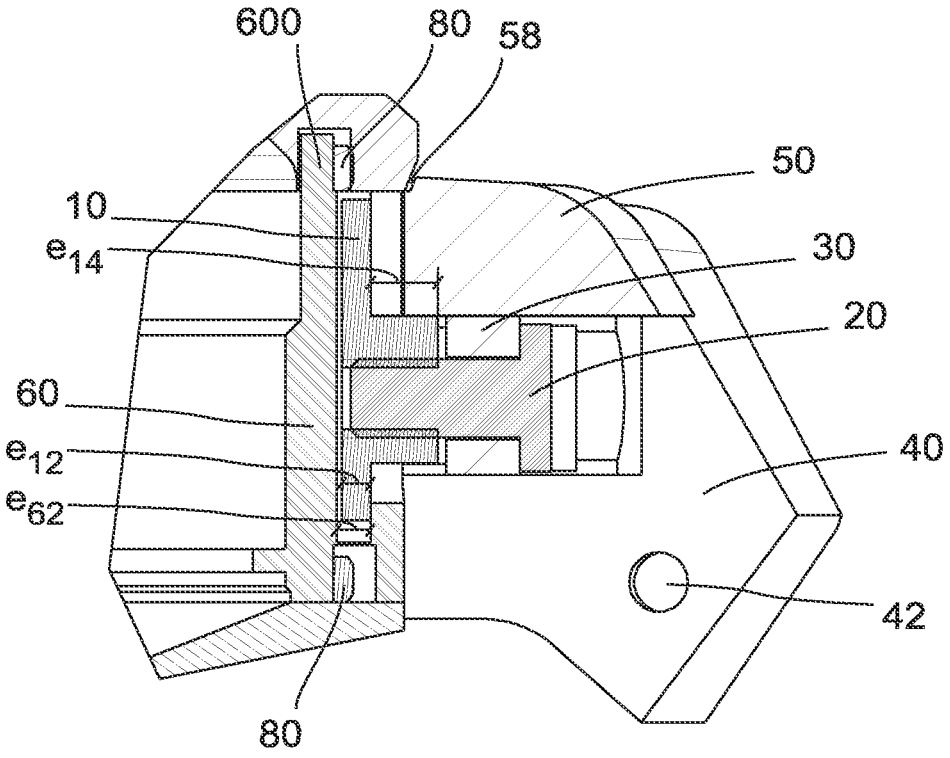
FIG. 2 illustrates a first sectional view of the embodiment of the fastening system of FIG. 1, in the x-z plane.
Figure 3:
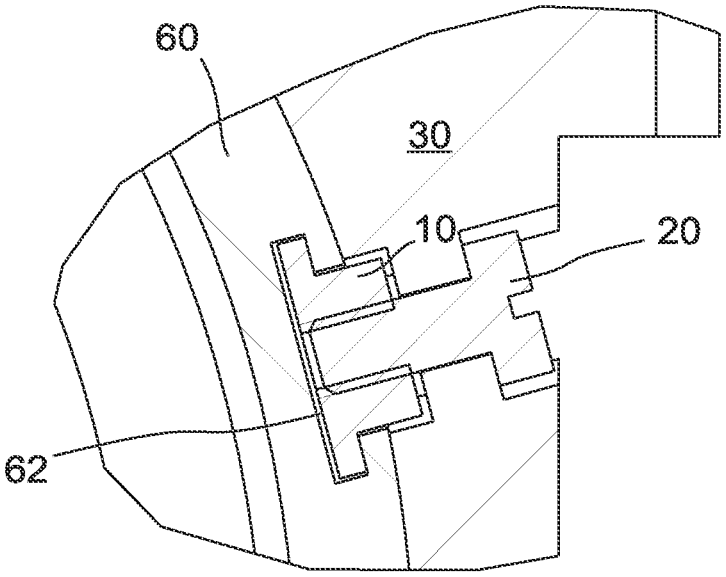
FIG. 3 illustrates a second sectional view of the embodiment of the fastening system of FIG. 1, in the x-y plane.

In the variant of FIGS. 1 to 3, the plate 12 and the nut portion 14 form a single piece 10, for example a metal part. However, they can be constituted by two separate parts connected to each other.

Advantageously, the height and the width of the slots 62 (in the direction z respectively y in FIG. 1) correspond to those of the plates 12. The thickness of the slots e62, visible in FIG. 2, is slightly greater than that e12 of the plate 12. In the context of the present invention, the expression "slightly greater" indicates that the slot 62 must allow the insertion of the plate 12 from the top edge 600 of the case middle 60, but that once the plate is inserted, it can no longer move in the slot along the y direction.

As shown in FIG. 2, the thickness of the plate 12 is less than that of the threaded element e14. In addition, the slot 62 of the case middle 60 and the tapped plate 10 are arranged so that the nut portion 14 extends radially protruding towards the outside of the case middle 60 when the nut 10 is slid into the slot 62, as can be seen in particular in FIG. 3.

Indeed, each housing 62 allows not only the threaded nut 10 to be inserted, but also the portion 14 to extend outwardly thanks to the opening 66 made in the outer lateral flank of the case middle.

In this way, the screw is not engaged in the thickness of the case middle 60, as in the prior art, but in the threaded nut portion 14 of the part 10. The case middle 60 can therefore be very thin, and therefore light, while ensuring a stable fastening of the horns 40.

In the example shown, the openings 66 have a "U" shape, which corresponds substantially to the shape of the plates 12, but this correspondence is not essential for the realization of the invention, and the opening 66 may have any another shape, provided that it allows the nut portion to be inserted from the upper edge 600 of the case middle 60.

The slot 62 thus allows the plate 12 to be accommodated in the thickness of the case middle 60, and the opening 66 allows the nut portion 14 to cooperate with the screw 20.

In the variant of FIG. 1, the connecting part 30 comprises two through holes 33, each hole 33 being adapted to receive a screw 20. In the illustrated variant, these holes 33 are formed in openings 32 made in the connecting part 30 and allowing the screw heads to be concealed.

In the variant of FIGS. 1 to 3, a cover 50 covers the connecting part 30 of the horns 40. The length of the cover corresponds substantially to that of the connection part 30. In the variant of FIG. 1, the cover 50 comprises lateral fins 56 which are arranged to slide in corresponding guides 46 provided in the horns 40.

As visible in FIG. 2, this cover comprises a surface 58 conforming to the shape of the portion of the bezel 80 with which it comes into contact. The nuts 10 are completely concealed by the connecting part 30, the cover 50 and/or the bezel 70.

In a variant embodiment, the connecting part 30 comprises a projecting tab 34, cooperating with a notch 64 on the lateral surface of the case middle, so as to ensure a vertical positioning of the connecting part 30 and of the horns.

In the variant illustrated in FIG. 1, this projecting tab 34 is completed on each side by two notches 36, allowing the connecting part 30 to be machined with a milling cutter. Without these two notches, the base of the tab 34 would have a radius of curvature due to the shape of the cutter, which would hinder its casing in the central notch 64 of the case middle 60.

In the variant of FIG. 1, this notch 64 is placed between two slots 62 of the fastening system according to the invention.

The present invention also relates to a watch including the watch case part described below.

The present invention also relates to a method for attaching removable horns to a case middle of a watch, comprising the following steps:

- sliding of at least one nut 10 into a slot 62 of the case middle,
- inserting at least one screw 20 into a through hole of a connecting part 30 of the two removable horns or into a through hole of a removable horn,
- screwing the screw 20 into the nut 10 so as to fasten the removable horns to the case middle.

REFERENCE NUMBERS USED IN THE FIGURES

10 Nut
12 Plate
14 Nut portion
20 Holding screw
30 Connecting part
32 Opening of the connecting part
33 Through hole of the connecting part
34 Tab of the connecting part
36 Notch of the connecting part
40 Removable horn
42 Means for attaching the horn to a bracelet
44 Means for attaching the horn to the connecting part
46 Guide
50 Connecting part
56 Fins of the connecting part
60 Case middle
600 Upper edge of the case middle
62 Housing in the case middle
64 Notch in the case middle
66 Opening
70 Bezel
80 Joint
e12 Thickness of the plate
e14 Thickness of the nut portion
e62 Thickness of the housing for the plate

What is claimed is:

1. Watch case comprising:
a case middle;
removable horns;
at least one nut removably inserted in a housing provided in the thickness of the case middle, with a nut portion protruding radially outwardly from the case middle; and
a detachable horn-holding screw radially engaged in each said nut,
wherein said housing comprises a slot in an upper edge of the case middle, said nut being inserted in said slot, and
wherein a direction of insertion of the nut is substantially perpendicular to a direction of engagement of the screw.

2. Watch case according to claim 1, each said nut comprising a plate for holding it in its housing and a threaded nut portion mounted on the plate.

3. Watch case according to claim 2, the thickness of the plate being less than 1 mm.

4. Watch case according to claim 2, the thickness of the plate being less than that of the nut portion.

5. Watch case according to claim 2, said plate and said nut portion forming a single piece.

6. Watch case according to claim 2, the thickness of the plate being less than 0.8 mm.

7. Watch case according to claim 2, the thickness of the plate being equal to 0.5 mm.

8. Watch case according to claim 1, comprising two said pairs of removable horns connected in pairs by a connecting part, said holding screws passing through said connecting part.

9. Watch case according to claim 8, comprising a cover arranged to cover the connecting part of the horns.

10. Watch case according to claim 8, the connecting part comprising a projecting tab, cooperating with a notch of the case middle, so as to ensure a vertical positioning of the connecting part.

11. Watch case according to claim 1, wherein the watch case has a radius, wherein the nut portion protrudes outwardly from the case middle, along a direction of said radius, and wherein the detachable horn-holding screw is engaged in each said nut along said direction of said radius.

12. Watch case comprising:
a case middle;
removable horns;
at least one nut removably inserted in a housing provided in the thickness of the case middle, with a nut portion protruding radially outwardly from the case middle; and
a detachable horn-holding screw radially engaged in each said nut,
wherein said housing comprises a slot in an upper edge of the case middle, said nut being inserted in said slot,
wherein each said nut comprises a plate for holding it in the housing and a threaded nut portion mounted on the plate,
wherein said slot is configured for inserting said plate in the upper edge of the case middle, and
wherein said housing comprises an opening on the outer lateral face of the case middle, for inserting said nut portion by the upper edge of the case middle, the projecting nut portion protruding outwardly of the case middle.

13. Method of attaching removable horns to a case middle of a watch comprising the following steps:
insertion of a removable nut in an upper edge of the case middle via a slot in the upper edge of the case middle, said insertion being performed in a first direction;
sliding of said nut in said housing of the case middle, such that a nut portion projects protruding outwardly of the case middle; and
screwing a screw into said nut so as to fasten a removable horn to the case middle, said screwing being performed in a second direction that is substantially perpendicular to the first direction.

14. Method according to claim 13, wherein the screw is radially screwed into said nut so as to fasten the removable horn to the case middle.

15. Method according to claim 13, wherein the watch case has a radius, wherein the nut portion protrudes outwardly from the case middle, along a direction of said radius, and wherein the detachable horn-holding screw is engaged in each said nut along said direction of said radius.

* * * * *